United States Patent [19]

Baren

[11] 3,955,682

[45] May 11, 1976

[54] LABORATORY SHELF FOR FUNNEL-SHAPED GLASSWARE

[75] Inventor: Louis Baren, Chicago, Ill.

[73] Assignee: Accurate Wirecraft Company, Chicago, Ill.

[22] Filed: Apr. 1, 1974

[21] Appl. No.: 456,656

Related U.S. Application Data

[63] Continuation-in-part of Ser. No. 345,578, March 28, 1973, Pat. No. 3,858,835.

[52] U.S. Cl. ..... 211/74; 23/292; 248/94; 248/311 A

[51] Int. Cl.[2] ..... B01L 9/00

[58] Field of Search ..... 248/94, 314, 315, 311, 248/312; 211/74; 23/292

[56] References Cited

UNITED STATES PATENTS

| | | | |
|---|---|---|---|
| 486,762 | 11/1892 | Camden | 248/292 X |
| 1,053,103 | 2/1913 | Martus et al. | 211/74 |
| 1,137,583 | 4/1915 | Cox | 248/311 |
| 1,268,867 | 6/1918 | Mojonnier | 23/292 X |
| 1,597,548 | 8/1926 | Sharp | 211/74 |
| 1,623,392 | 4/1927 | Davidson | 248/311 |
| 1,643,735 | 9/1927 | Baker | 211/74 |
| 2,180,042 | 11/1939 | Ettinger | 211/74 |
| 2,195,988 | 4/1940 | Hoeruegel | 248/292 X |
| 2,320,482 | 6/1943 | Stenzel et al. | 23/292 X |
| 2,562,443 | 7/1951 | Barbour et al. | 248/314 X |
| 2,607,554 | 8/1952 | Charipar | 248/312 |
| 3,131,011 | 4/1964 | Rittenberry | 211/74 X |
| 3,516,801 | 6/1970 | Shah | 248/311 X |
| 3,532,318 | 10/1970 | Lloyd | 248/311 |
| 3,589,338 | 6/1971 | Lovitz | 248/311 X |
| 3,752,651 | 8/1973 | Bush | 23/292 X |
| 3,858,835 | 1/1975 | Baren | 248/94 |

FOREIGN PATENTS OR APPLICATIONS

| | | | |
|---|---|---|---|
| 107,302 | 11/1924 | Switzerland | 248/311 |

OTHER PUBLICATIONS

"Schaar, Neoprene-coated, Fully Adjustable Funnel Support", p. 9, Laboratory, Schaar and Company, May, 1952.

*Primary Examiner*—Roy D. Frazier
*Assistant Examiner*—Rodney H. Bonck
*Attorney, Agent, or Firm*—Alter and Weiss

[57] ABSTRACT

A wire frame shelf with longitudinally displaced conically-shaped, coaxial, funnel holders with an elongated vertical front clearance space on each funnel holder. The funnel holder is larger in the upper portion to receive and embrace a tapered glassware device in the axially displaced circumferential opening. Thus, the opening provides the glassware device with horizontal support, vertical stability, and a convenient resting place for protuberance on the glassware device.

3 Claims, 5 Drawing Figures

LABORATORY SHELF FOR FUNNEL-SHAPED GLASSWARE

This application is a Continuation-in-Part of my prior patent application Ser. No. 345,578 filed on Mar. 28, 1973, issued Jan. 7, 1975, as U.S. Pat. No. 3,858,835.

This invention relates to shelves, and more particularly to shelves for funnel-shaped laboratory glassware, especially those with petcocks at their lower surface.

Laboratory glassware, in particular funnels or flasks with petcocks, are usually quite expensive, easily broken, and sometimes hard to handle. The nature of their use requires them to be washed, sterilized, dried, transported and stored.

The clamps and shelves or racks which in the past have been used in laboratories, have required constant adjustments. There further was the hazard of inadequately tightening the clamp, the clamp with the glass falling and breaking the glass. There also was the problem of movement of the petcock and funnel. All these difficulties caused laboratory workers to devote more time to adjusting clamps and shelves than to actual laboratory work.

Accordingly, an object of this invention is to provide a new and improved shelf for laboratory glassware. In this connection a related object is to provide a shelf adapted for use with any different sized or type laboratory funnel with a petcock, the shelf also being adapted to fit almost any adjustable stand and accommodate glassware with virtually any stem length.

Another object is to provide an assembled shelf for funnels with petcocks and thereby eliminate the necessary clamp adjustment.

A further object is to provide an easily transportable shelf. Here, an object is to provide a funnel shelf which will withstand extremities in temperature, i.e. sterilization and refrigeration, will not absorb the temperature of the surrounding glass, and avoid damage from almost all laboratory-associated liquids.

Yet another object is to provide a shelf in which the petcock is stationary and therefore easily handled and reached.

A further object is to provide a rack in which funnels may be kept in series and easily hooked up to one another or other laboratory glassware.

Still another object is to provide laboratory shelf in which the funnels are held stationary and will not move, or tip over.

In keeping with an aspect of the invention, these and other objects are accomplished by an elongated wire frame shelf for laboratory glassware having on either side thereof longitudinally displaced conically-shaped, coaxial, funnel holders with an elongated vertical front clearance space on each funnel holder. The funnel holder is larger in the upper portion to receive and embrace in the axially displaced circumferential opening a tapered glassware device that cannot be conveniently vertically supported. The front clearance space on each funnel holder facilitates insertion or removal of the funnel-shaped glassware, and the bight at the slot bottom acts to hold the glassware protuberance, i.e., a petcock, firmly in place and easily manipulated. Thus, the opening provides horizontal support, vertical stability, and a convenient resting place for a petcock on the glassware device.

The nature of a preferred embodiment will be understood best from a study of the attached drawings wherein.

Figure 1:
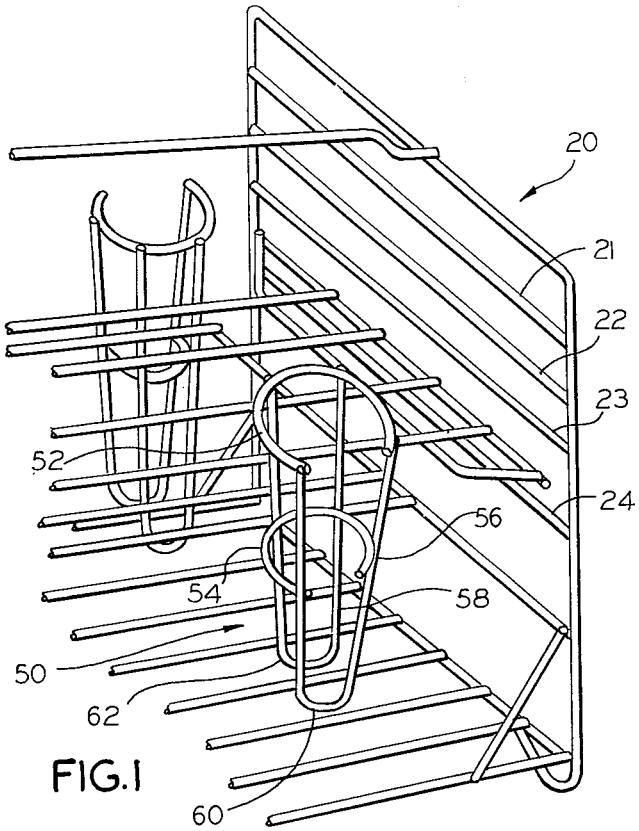
FIG. 1 is a schematic partial perspective view of a stand showing the funnel shelf incorporating the principles of the invention attached thereon.
Figure 2:
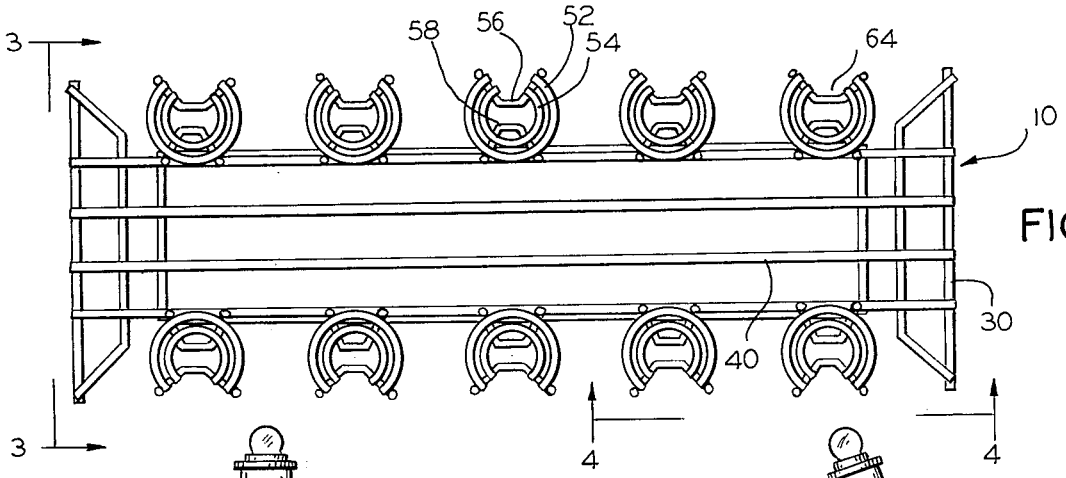
FIG. 2 is a plan view of the inventive shelf.

By way of example, the shelf of FIG. 1 is made primarily of spot welded heavy gauge steel wire. The shelf 10 is disposed in stand 20 along horizontal members 21, 22, 23, 24. The shelf 10 may be placed on any convenient stand or support and is supported on the horizontal rods 30. The length and width of the shelf are flexible and may be supported in any convenient stand.

The shelf 10 includes a plurality of conical funnel holders 50 displaced longitudinally along each side thereof, the cone apex extending below the shelf surface. Each of the conical funnel holders 50 has a pair of planar frame members 52, 54 disposed at two points thereof in aligned spaced parallel relationship. By way of example, the members 52, 54 are shown as partially closed loops 52, 54 parallel to the shelf. The first loop 52 is located at the base of the conical-shaped holder, while the second loop 54 is located approximately midway down the funnel holder. The upper loop 52 is larger in size than the second loop 54. Two U-shaped supports 56, 58 external to the frame members 52, 54 extend perpendicularly from the upper loop 52. The first U-shaped support 56 is spot welded or otherwise attached to the front of the loops 52, 54. The second U-shaped support 58 is spot welded or otherwise attached at the rear of the loops 52, 54, and also attached to the shelf horizontal rods 40. The U-shaped supports 56, 58 are larger at the top portion, and taper downward to form bights 60, 62 at the bottom thereof.

Figure 3:
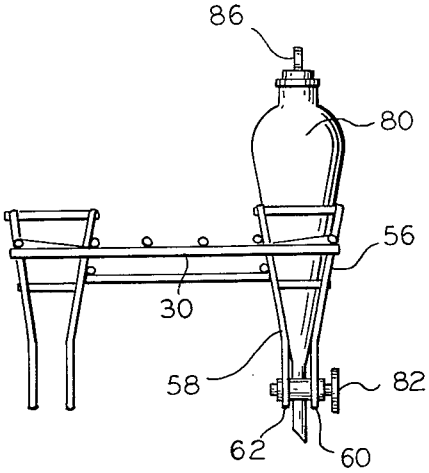
FIG. 3 is an end view of the shelf with a funnel in one side thereof taken along line 3—3 of FIG. 2 and looking in the direction of the arrows.

A tapered flask 80 with a tapered axial periphery and a protuberance 82 can be placed in the funnel holder 50. As seen in FIG. 3 the protuberance or petcock 82 is faced forward, and is resting in the bights 60, 62 of the U-shaped supports 56, 58, after the tapered flask 80 is completely within the funnel holder 50, and supported by the loops 52, 54 at a top and central location. The tapered flask 80 nests in loops 52, 54 and the vertical axis of the flask always forms a right angle perpendicular to the horizontal axis, thereby insuring stability of the tapered flask.

Each funnel holder 50 has a clearance space 64 formed in the front. This allows the petcock 82 to slide down to the bights 60, 62 without encountering interference which could lead to breakage.

Figure 4:
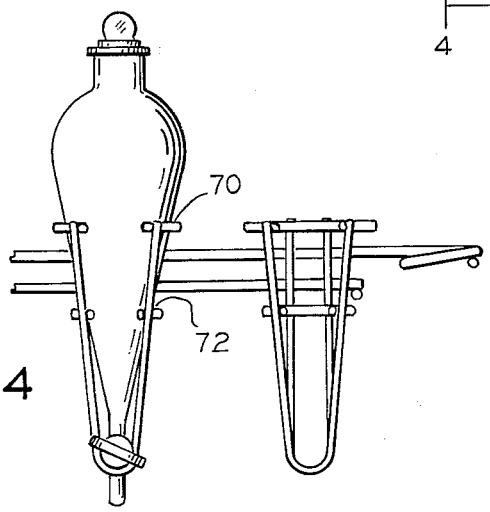
FIG. 4 is a side view of the shelf with a funnel in one holder thereof taken along line 4—4 of FIG. 2 and looking in the direction of the arrows.
Figure 5:
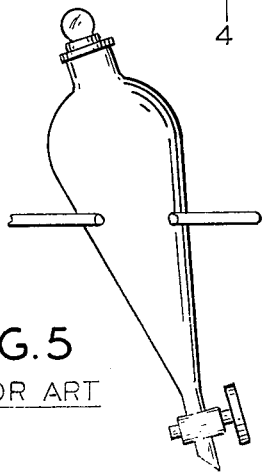
FIG. 5 PRIOR ART
FIG. 5 shows how the prior art shelf lacks the facility required to give vertical stability to funnel-shaped objects.

The nature of the inventive concept may become apparent from a comparison of FIGS. 4 and 5. As shown in the prior art, FIG. 5 device, a funnel-shaped glassware is shown tipped over vertically. By providing the invention, a flask can be held stably and vertically as shown in FIG. 4 rather than in the tipped position as shown in FIG. 5.

As shown in FIGS. 3 and 4 the loops 52, 54 and supports 56, 58 are shaped and proportioned to receive and embrace a tapered funnel-shaped glassware object 80 nested in two axially displaced positions 70, 72. The petcock 82 is also shown nested in bights 60, 62 for further support. Thus, as the funnel nests in loops 52, 54 and U-shaped supports 56, 58, the vertical axis of the glassware funnel object 80 always forms a right angle perpendicular to the horizontal.

There are many reasons why the vertical alignment is important. In the attaching of glass piping to the head 86 of the flask 80 a rigid attachment must be maintained. A slight deviation of the angular position of the flask 80 will cause excess stress and possible breakage of the glass pipes. However, with this invention, such a change of angularity is obviated. The flask 80 is securely held in a single vertical position.

The wire shelf, while made out of metal, is dipped in plastomer material, preferably neoprene rubber, to cover all sharp points and edges. This acts to prevent the lab worker from injury, and prevent damage to the glassware. The rubber covering further protects the shelf from damages due to laboratory chemicals.

The appended claims are to be construed to cover all equivalent structures falling within the scope and spirit of the invention.

I claim:

1. A wire frame shelf for funnel-shaped laboratory glassware with petcocks, comprising:

a plurality of horizontally displaced holders;

each of said holders comprising at least two vertically disposed concentric partial rings;

each of said partial rings being defined by a wire arcuate in configuration and terminating in spaced ends, said ends defining vertically aligned slots, a pair of depending U-shaped supports;

each of said U-shaped supports being formed of a pair of substantially vertical uprights spaced to define an opening therebetween;

each of said pair of uprights joined at its lower end to the other of said pair to form a bight;

each of said U-shaped supports being secured to each of said partial rings;

the first of said U-shaped supports having its uprights secured on opposite sides of said slots, with said opening in alignment with said slots;

the second of said U-shaped supports having each of its uprights fastened to each said partial ring opposite from the first of said U-shaped supports; and said opening defined by said uprights of the second of said U-shaped supports in alignment with the opening defined by said uprights of the first of said U-shaped supports.

2. The apparatus as recited in claim 1, wherein:

said shelf and said holders are covered with plastic neoprene rubber material.

3. The apparatus as recited in claim 1, wherein:

said partial rings are of different diameters;

said rings being arranged top to bottom in order of decreasing diameter.

* * * * *